United States Patent [19]

Brunner et al.

[11] 4,439,403

[45] Mar. 27, 1984

[54] APPARATUS FOR CONDITIONING BIOINJURIOUS WASTE

[76] Inventors: Herbert Brunner, Grünaustrasse 15, 6450 Hanau 9; Bernhard Christ, Schwalbenstrasse 22, 6090 Rüsselsheim; Wilhelm Henss, Gartenstrasse 5 a, 6454 Bruchköbel; Werner Pfeifer, Mittelweg 34, 6380 Bad Homburg; Klaus Scheuermann, Am Höhenblick 27, 6476 Hirzenhain, all of Fed. Rep. of Germany

[21] Appl. No.: 240,829

[22] Filed: Mar. 5, 1981

[30] Foreign Application Priority Data

Mar. 8, 1980 [DE] Fed. Rep. of Germany ..... 3009005

[51] Int. Cl.[3] ..... G21F 9/22

[52] U.S. Cl. ..... 422/159; 141/87; 141/284; 141/285; 366/261; 366/286; 422/225

[58] Field of Search ..... 366/247, 249, 261, 285, 366/286, 731; 141/87, 284, 285, 59; 252/631; 280/43.22, 43.24; 422/159, 225; 220/420, 425, 466, 469

[56] References Cited

U.S. PATENT DOCUMENTS

| | | | |
|---|---|---|---|
| 2,226,970 | 12/1940 | Engel | 280/43.22 |
| 3,178,266 | 4/1965 | Anthon | 141/284 |
| 3,365,092 | 1/1968 | Blessing | 220/469 |
| 3,831,644 | 8/1974 | Berg et al. | 141/284 |
| 3,971,732 | 7/1976 | Meier | 422/159 |
| 4,196,169 | 4/1980 | Gablin et al. | 422/159 |
| 4,234,447 | 11/1980 | Hay et al. | 422/159 |
| 4,261,501 | 4/1981 | Watkins et al. | 220/469 |

FOREIGN PATENT DOCUMENTS

| | | | |
|---|---|---|---|
| 767854 | 9/1967 | Canada | 422/26 |

OTHER PUBLICATIONS

*Sakraida V. Ag Pro,* 189USPQ 449 (1976).

*Primary Examiner*—Michael S. Marcus
*Attorney, Agent, or Firm*—Cushman, Darby & Cushman

[57] ABSTRACT

There is described an apparatus for handling and conditioning biologically injurious waste, especially radioactive waste which consists of a working space or chamber having containers for receiving and dosing the waste, conveying and control devices for the waste and the additions and a filling station for filling the final storage container. It is characterized by the working space having a slanting bottom running into a sump, the containers for receiving and dosing the waste being surrounded by a variable shielding, the cover of the final storage container provided with a stirrer convertable to the stirrer driving mechanism taking place by means of a slidable lift which supports the driving mechanism, a waste supply line, a waste air line, a positioning device and stopping pins, and controlling the sequence of operations by a freely programmable control.

17 Claims, 11 Drawing Figures

APPARATUS FOR CONDITIONING BIOINJURIOUS WASTE

BACKGROUND OF THE INVENTION

The invention is directed to an apparatus for handling and conditioning bioinjurious waste, especially radioactive waste consisting of a working space or chamber having containers for receiving and dosing the waste, conveying and controlling devices for the waste and additive materials as well as a filling station for filling the final storage containers.

In numerous living areas there are formed wastes which according to their nature are toxic, radioactive or in other manner, load the environment. Because the danger there are laws pertinent especially to the handling and storage of such wastes. These wastes include for example, nuclear power plant wastes, scientific and medicinal wastes from industry, research centers and hospitals, as well as other chemical-biological wastes. The treatment of the waste preponderantly takes place at the place where the waste is obtained, frequently with mobile conditioning apparatus.

There are known a whole series of processes according to which the wastes mentioned can be deposited in solid form the use of the particular solidification process thereby is chiefly dependent on the type of waste. Such conditioning processes and apparatus are described in several publications (e.g., German AS No. 1199414, German AS No. 1771244, German OS No. 2228938, German OS No. 2249563, DL patent No. 40837, German OS No. 2421142, German GM No. 7711596).

In the known conditioning apparatuses particularly disadvantageous, are their lack of compact construction, the contamination problems it brings with it, additionally a high transportation weight contingent upon expensive final storage container—conveying devices, furthermore the only limitedly variable possibilities for application in regard to the conditioning of wastes of different radioactivity, additionally in regard to accidents and the setting free of volatile or aerosol dust respectively from injurious materials, the existing industrial safety equipment.

Therefore, it was the object of the present invention, to develop an apparatus for the conditioning of bioinjurious waste, especially radioactive waste consisting of a working space having containers for receiving and dosing the waste, conveying and control devices for the waste and the additives and filling stage for the final storage containers which is laid out compactly, has a relatively low transportation weight, permits a variable insulation, is constructed for economical operation and industrial safely.

SUMMARY OF THE INVENTION

This problem was solved according to the invention by providing a working space having a slanting bottom running into a sump, the containers for receiving and dosing the waste being surrounded by a variable shielding, the cover of the final storage container being provided with a stirrer connectable to the stirrer driving mechanism taking place by means of a slidable lift which supports the driving mechanism, a waste supply line, a waste air line, a positioning device, and stopping pins, and controlling the sequence of operations by a freely programmable control.

BRIEF DESCRIPTION OF THE DRAWINGS

The apparatus of the drawings is shown in more details schematically in illustrative form in FIGS. 1 to 11 of the drawings therein.

DETAILED DESCRIPTION OF THE INVENTION

Figure 1:
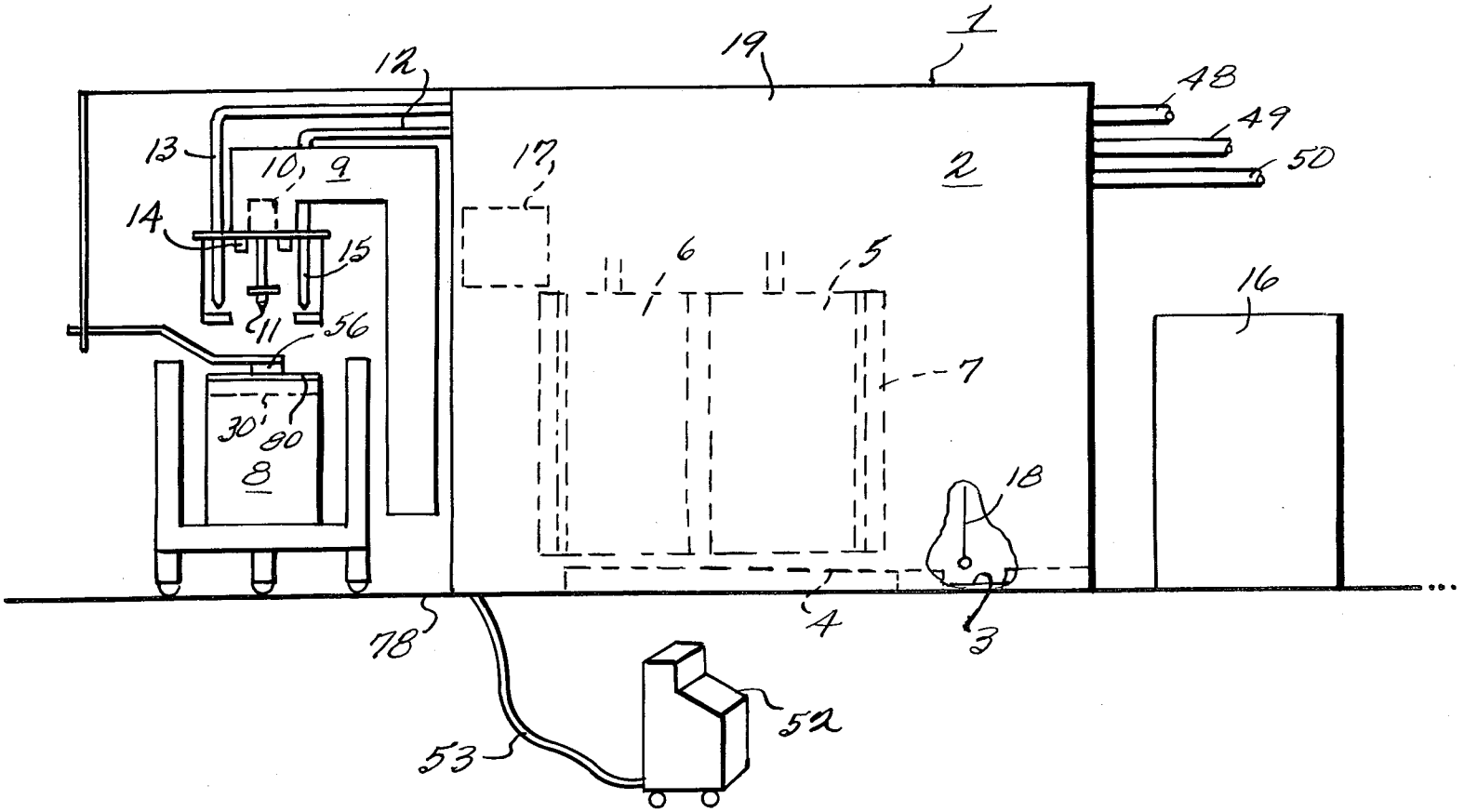
FIG. 1 is a side view of the apparatus of the invention.
Figure 2:
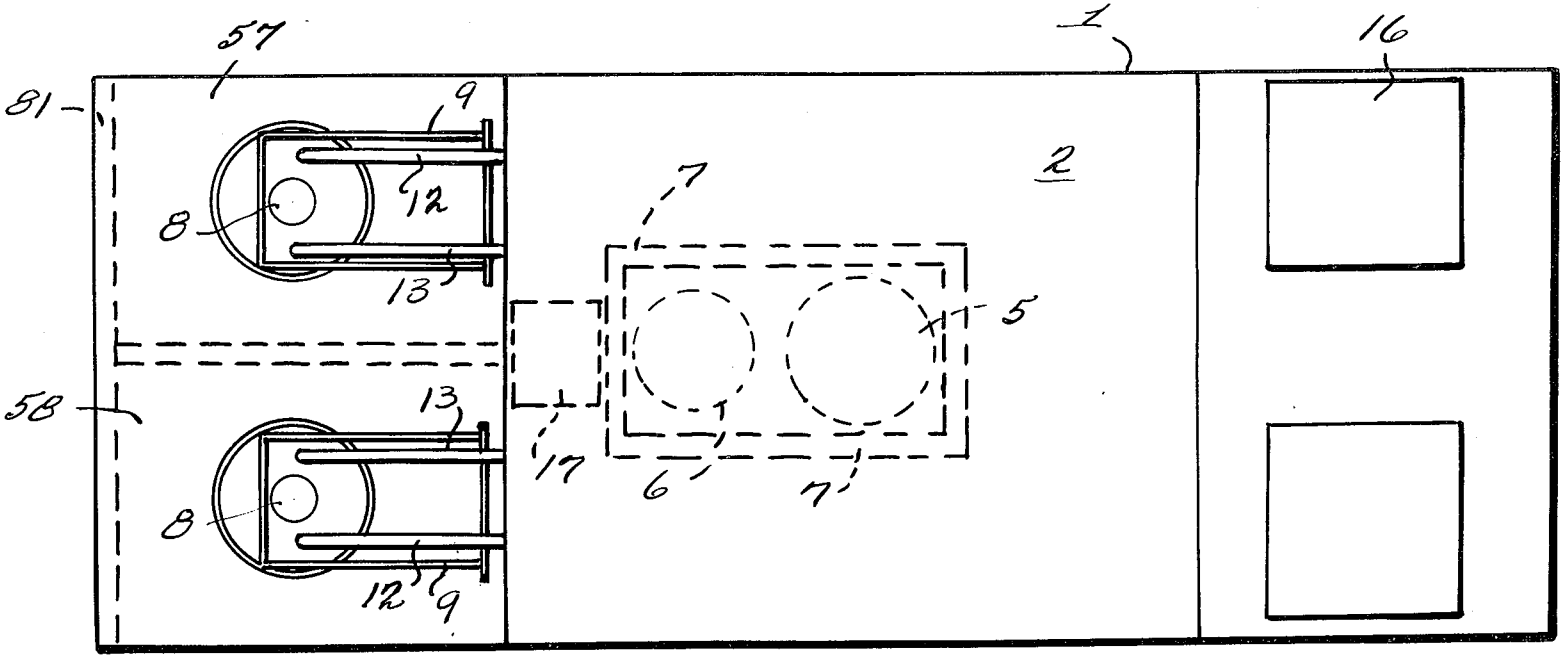
FIG. 2 is a plan view of the apparatus of the invention.

Referring more specifically to the drawings the waste conditioning apparatus 1 of the invention has a working space or chamber 2 whose cover 19 is arranged as an assembly opening. The working space 2 also contains the auxiliary equipment containers 5 and 6 for receiving and dosing the bioinjurious waste. The filling of the containers 5 and 6 takes place for example via a connection 48 for globular resinous waste and via a connection 49 for sludge. A connection 50 serves for supplying deionized water. The shielding 7 around the containers 5 and 6 for protection against radiation is variably constructed e.g. of lead blocks, according to the purpose of employment of the apparatus of the invention. It is particularly advantageous to so form the arrangement of the container that for the case that only one of the containers 6 or 5 is used, the other container acts with corresponding filling, e.g. with water or suitable bulk material as shielding for the second container. The radioactive waste is received in the containers 6 and 5 by means of provided apparatus 16 and 17, closed and subsequently conveyed to the filling stations 57 and 58 where the waste is filled into final storage containers 8 which contain predeposited solidification agents and the waste is solidified. The apparatus of the invention preferably contains several filling stations 57 and 58 so that a more economical sequence of operations is possible. Also suitable is the use of one filling station 57 for globular resinous waste and the other filling station 58 for sludge waste. Before filling the final storage container 8 there is lowered a slidable lift 9 to an intermediate cover 30 and it is connected there. During the filling the final storage container 8 advantageously standing in a shielding container 47 is fixed to a transportation equipment 44 which is in the filling position. After the filling the sliding lift 9 is raised and cover holding apparatus 51 closes the container. Subsequently the final storage container is transportated away. The inside of the working space 2 has a slanting bottom 4 running into a sump 3. The leakages in a given case collecting in the sump 3 are monitored by measuring instrument 18. Advantageously the control is carried out via a control panel 52 which is joined with the apparatus 1 via flexible cable 53. The apparatus 1 has container measurements and therefore is easily transportable and variably employable. The control of the apparatus is freely programmable, fixedly wired safety controls are missing. Through this there is first accomplished the compact construction and for the rest there can be quickly carried out changes in the programming of waste. By electronic cycle testing the correct carrying out of the orders is quaranteed. Time delays or failures, e.g. of valves, etc., shut off the start of power of the control until elimination of the disturbances and quitting. The apparatus thus is always converted into the safe condition with disturbances.

Figure 3:
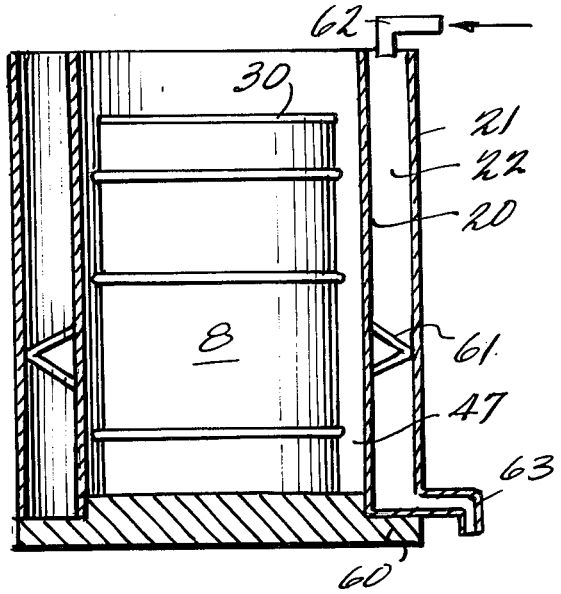
FIGS. 3, 4 and 5 show the receiving and dosing container.
Figure 4:
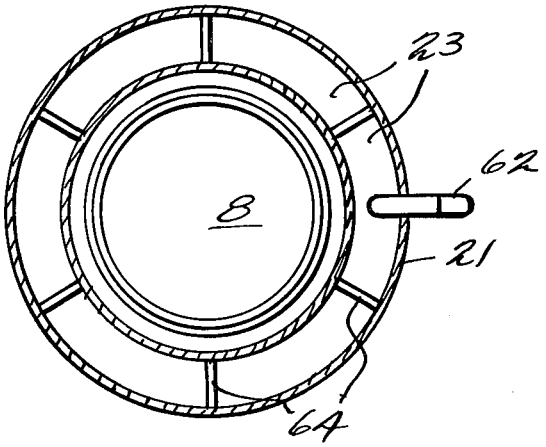
Figure 5:
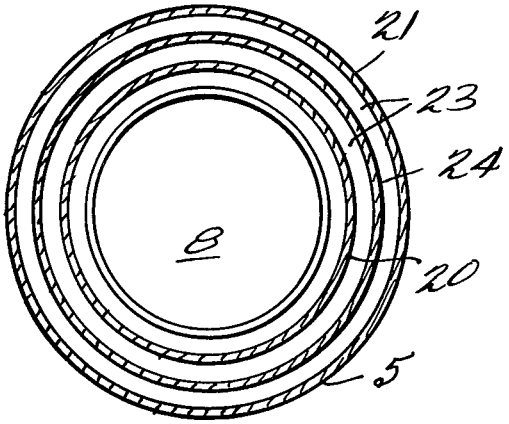
Figure 6:
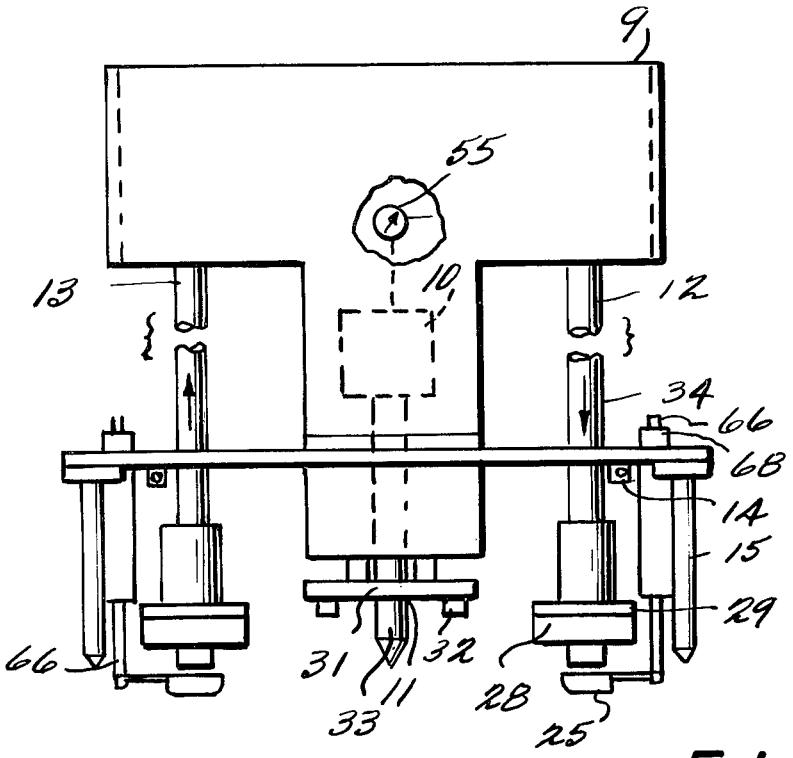
FIGS. 6, 7 and 8 show the slide lifts and related devices.
Figure 7:
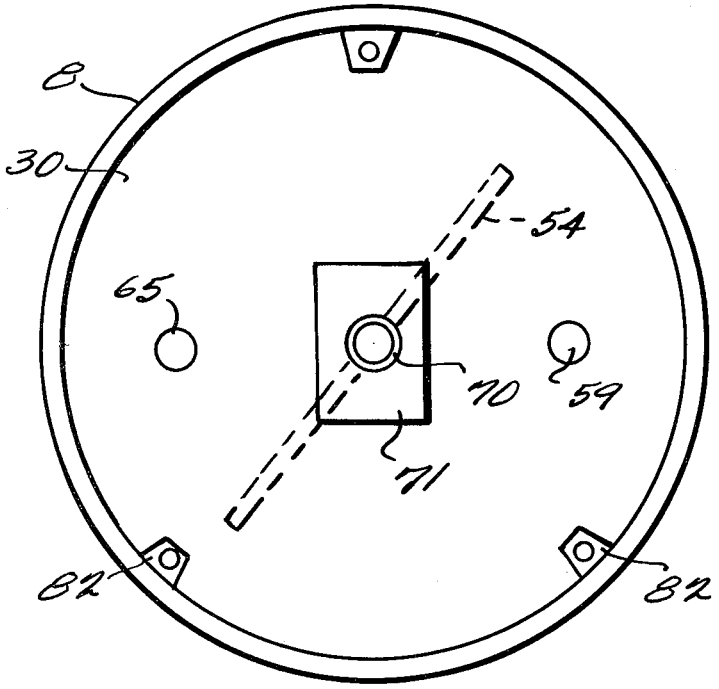
Figure 8:
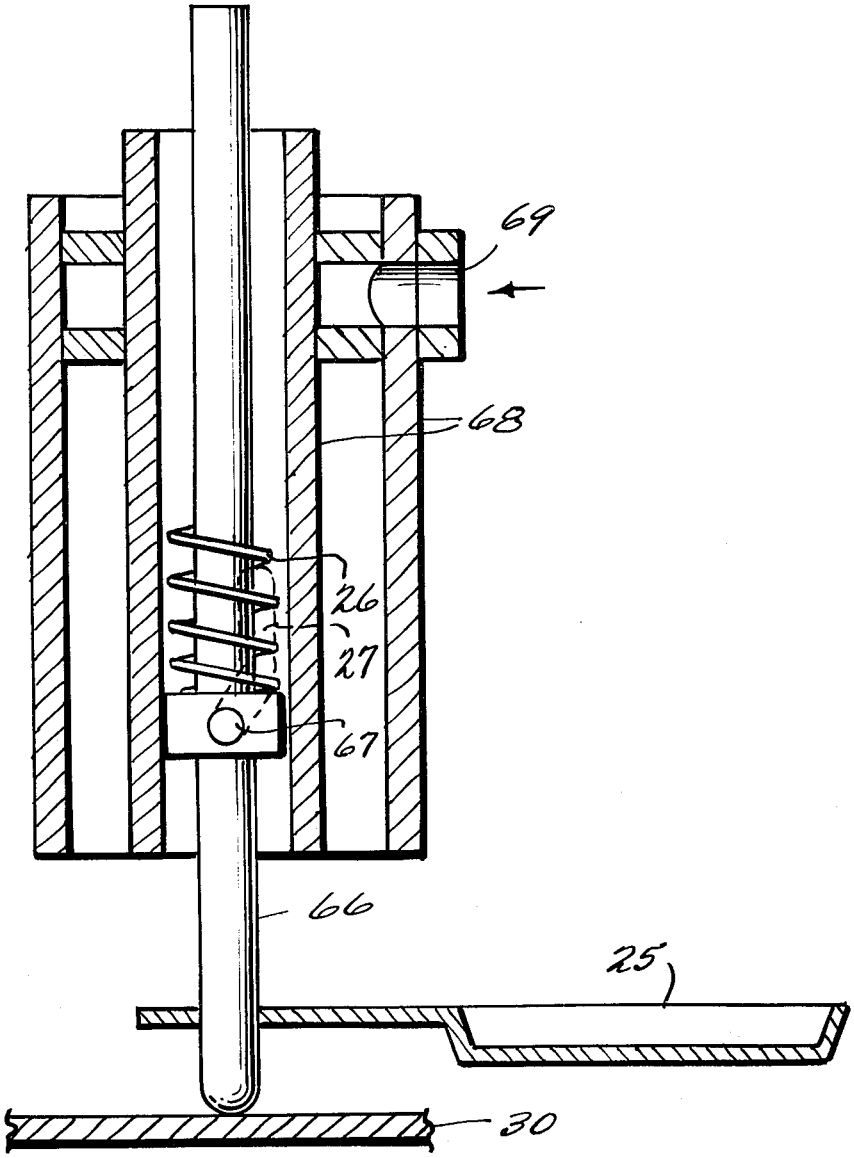
Figure 9:
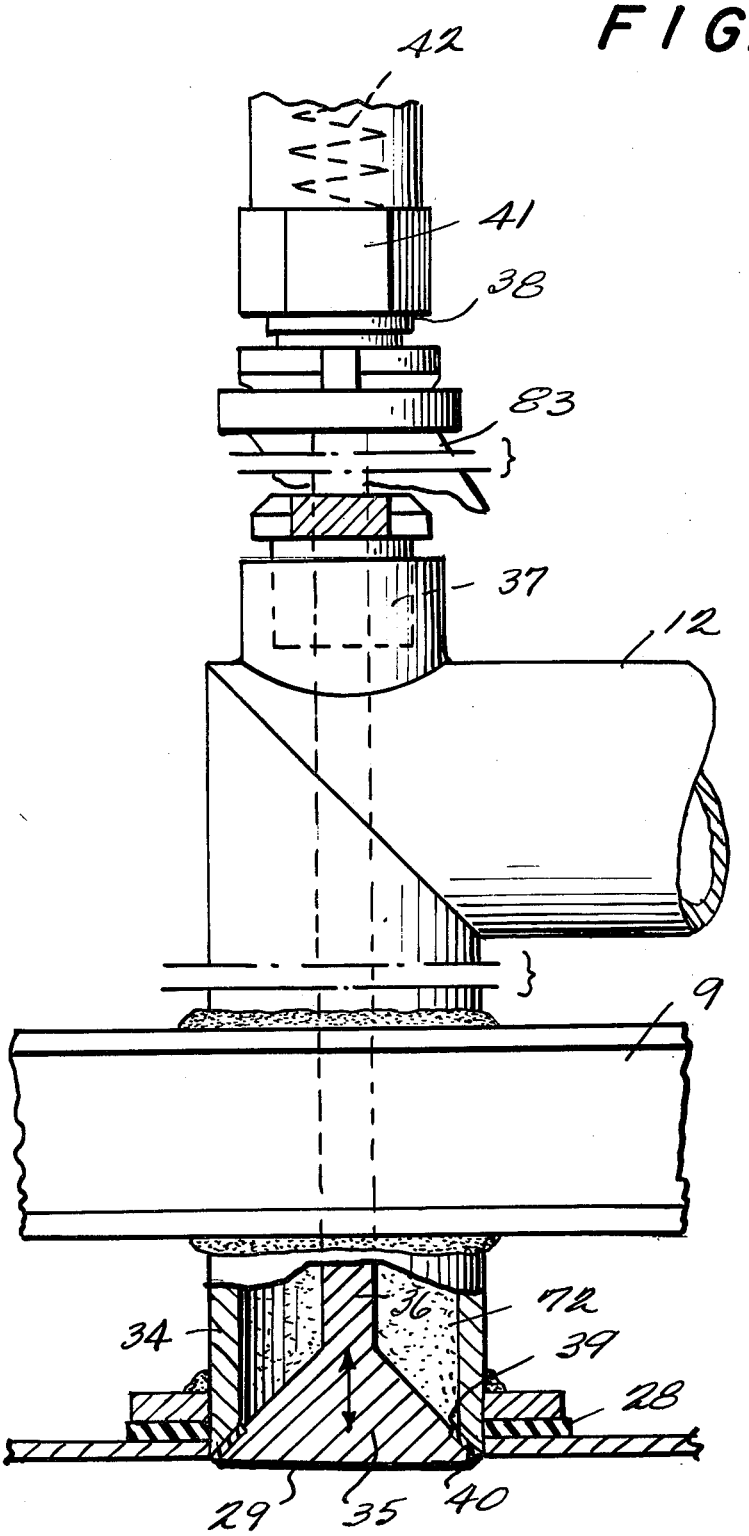
FIG. 9 shows the pipe closure of the waste supply line.
Figure 10:
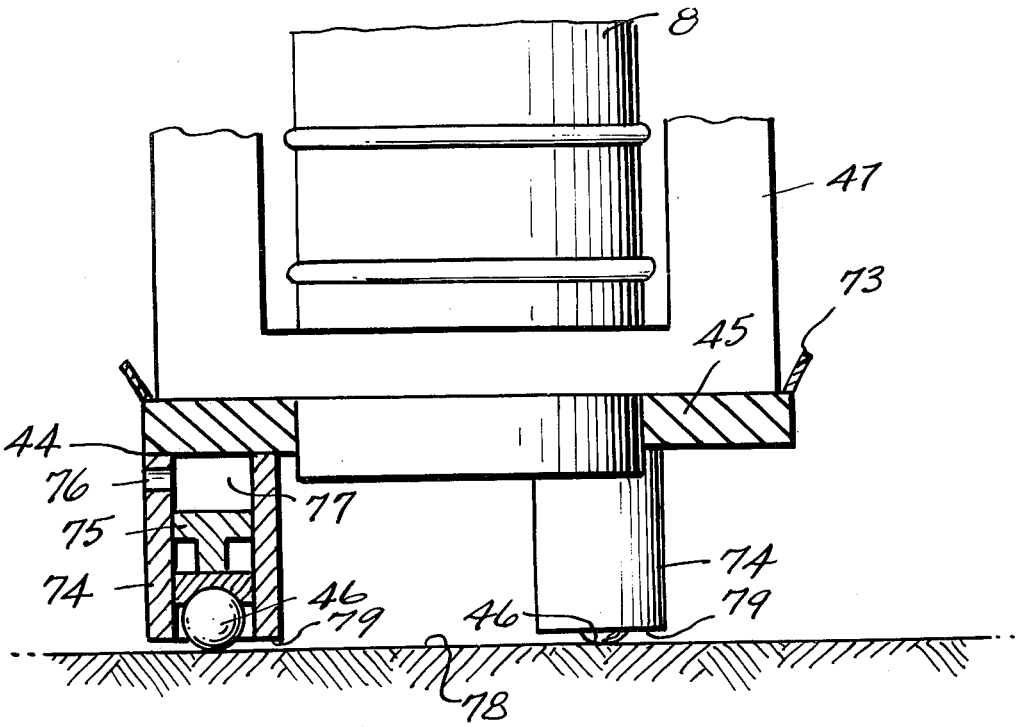
FIGS. 10 and 11 show the transportation equipment.
Figure 11:
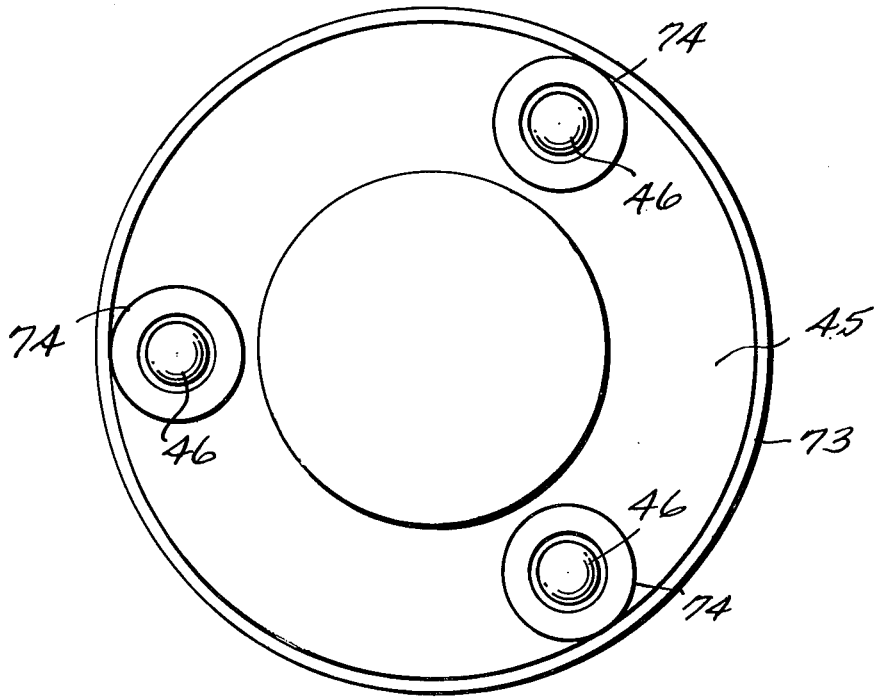

The design of the individual components of the apparatus 1 is set forth in detail in FIGS. 3 to 11.

The final storage container 8 having an intermediate cover 30 which contains a passage for the stirrer shaft 70 connected at the upper end and constructed as a tube for the stirrer 54 mounted in the final storage container 8 as well as an opening for the waste supply 59 and the waste air 65 is, positioned by moving and turning, e.g. by means of a lift truck disposed in the filling and mixing position, to a hauling vehicle 44 having a support 45 and with the help of a positioning device 14 which contains a spot of light. By lowering the slidable lift 9 in one step there is swung away the swivelable pan 25 serving as protection against dropping and located under the waste supply line 12, the stirrer 54 centered by means of coupling 11 and the drive shaft of the driving mechanism 10 connected and drum grasping pins 15 in holding clips 82 which are located in the intermediate cover 30 is driven in. The downward movement of the slideable lift 9 is stopped via a terminal switch; the waste supply line 12 which, as is the waste air line 13, is carried in the corresponding openings 59 and 65 is released by a contact switch. Thereby it has proven particularly favorably to equip the ends of the lines 12 and 13 with gaskets 28 which are pressed by means of springs 29 to the intermediate cover 30. The contact switch for releasing the waste supply line 12 can be suitably integrated in the gaskets 28.

After the end of the dosaging and mixing process the slidable lift 9 travels back from its operating position upwardly into its resting position. During this upward movement the swivel pan 25 is swung back below the waste supply and waste air line 12 and 13 and the gaskets 28 pressed on.

The filled final storage container 8 is finally suitably closed by a final cover 80 and transported away.

It has been shown to be particularly advantageous if the swivel pan 25 is secured on a shaft which contains a pin 67 led into a curved slot 27 so that the swinging process is released with the help of the tension or release from tension of a spring element 26. The guiding of the shaft 66 is carried out in a guide element 68. It is also especially favorable, e.g. via a connection 69 to pneumatically press the swinging pans 25 on the gaskets 28.

The formation of the stirrer connection 11 with a flat iron 31 as well as 2–4 carrier bolts 32 and a centering pin 33 has proven particularly favorably because of its robustness, likewise the use of two light indicators for the positioning device 14. The centering pin 33 centers the stirrer 54 by driving its point into the upper open end of the stirrer shaft 70 while the carrier bolts 32 rotatingly move with an element 71, for example a welded flat iron, fastened at the upper end of the stirrer shaft 70 in the connected operating condition and thus drive the stirrer 54.

Preferably the driving mechanism 10 for the installed stirrer 54 of the final storage container 8 is connected with a dynamometer 55. Therewith it is possible to utilize in the stirring of the mixture of waste, solidifying agent and liquid other mixing properties, e.g. viscosity, as possible controls for the conditioning.

The slidable arrangement of the stopping pins 15 on the slidable lift 9 has proven especially advantageous in the change of size of the final storage container.

It has proven particularly favorable if the tube 34 of waste supply line 12 contains a conical valve 35 as closure which is connected via a shaft 36 with a drive 38. The shaft 36 is led through the tube 34 by means of a sealed passage 37. The drive 38 fastened on a stopping device 83, hence permits the axial movement of the conical valve 35 extends into the storage container and releases the bioinjurious or radioactive material via the thus formed annular shaped opening constructed of the end of the tube 34 providing a sealing surface 39 and the spherical jacket-sealing surface 40. In the closed position after filling the spherical jacket-sealing surface 40 seals with the sealing surface 39 at the end of the tube 34, whereby sealing surfaces of metal have proven particularly good, so that the tube 34 can be carried away without danger from the filling opening 59 in the intermediate cover 30 by means of the slidable lift 9.

It has also proven especially favorable if the drive 38 consists of a compressed air cylinder 41 and a return spring 42 with which the axial movement of the conical valve 35 is carried out. Suitably the lift of this axial movement is so limited that it is less than the axial length of the sealed passage 37. In many cases also the shape of the bottom 29 of the conical valve 35 is of particularly advantage.

It is particularly advantageous if the containers 5 and 6 and/or the shielding container 47 are constructed with double walls having a fillable hollow space between the walls. Between the double walls 20 and 21 there is located a hollow space 22 which can be filled with suitable radiation protective material for the particular case. The double walls 20 and 21 is secured to a solid bottom 60. However, the bottom likewise can also be constructed in particular cases as a double wall. There have proven particularly favorable for stabilization and maintaining the geometry of the fillable hollow space 22 spacing containers 61 whereby the spacing container 61 suitable forms an angle facing the container radius. According to the situation presented, the hollow space 22 needs to be filled only at the place of employment with water, suitable solutions or loose material or other ray absorbing materials. Additional inlet and outlet devices 62 and 63 have proven particularly favorable for filling and later emptying the hollow space 22.

It is also particularly advantageous to divide the fillable hollow space 22 by partitions 64 into several compartments 23. Through this it is possible in special cases to have different filling with shielding material. It is especially advantageous to divide the hollow space 22 by concentric walls 24 into several concentric compartments 23.

The containers 5, 6, and 47 in a given case can be completely dedicated by filling the hollow space with concrete or other material in a so-called "lost concrete shielding". It has proven especially favorably thereby to insert a sheet of diffusion stopping material, for example sheet aluminum against tritium permeation. In filling the hollow space with concrete or other material the spacing container 61 additionally serves as reinforcement.

The hauling vehicle 44 has proven itself as a particularly favorable construction element of the apparatus of the invention in the filling stage of the final storage container 8. A shielding container 47 which contains the final storage container 8 stands on a support 45 of the hauling vehicle 44 to which is fastened a centering device 73. There are mounted on th support 45 tubular elements 74 which are constructed internally as hydraulic cylinders. There are fitted into the tubular elements 74 hydraulic pistons 75 on the lower side of which is located a ball element 46, movable in all directions and suitably mounted. The hydraulic medium is conveyed through an opening 76 into a space 77 of a cylinder by means of a pump and supply line. Thereby the support 45 is raised with the load so that the ball element 46 is operable in all directions on the floor 78 and the support 45 with the load can be brought both quickly and exactly into the filling position. In the filling position the support 45 is again lowered and again stands firmly on the floor 78. Thus devices such as conveyor belts, course of rollers, etc. can be eliminated. Therewith in mobile waste conditioning plants there are also eliminated considerably transportation weight as well as generally at least partially the expense of decontamination. It is suitable to connect the hydraulic drive via a common ring conduit with the ball elements 46.

However, the lowering of the ball elements 46 can also take place either mechanically or electrically, although the hydraulic movement has proven particularly favorable.

Also especially advantageous are the annular construction of the support 45 as well as the use of three lowerable ball elements 46 on the bottom surface 79 of the support 45.

After filling the final storage container 8 the cover holding apparatus 51, places the final cover 80 on by means of a gripping device 56. The centering as well as the closing is carried out with suitable remote control devices. The gripping device 56 preferably operates by means of suction or magnetically. The cover holding apparatus is positioned through a drive. Since the filling station and correspondingly by partially variable shielding walls 81 for the radiation protection requirements of the environment the positioning can also be carried out manually in such case.

What is claimed is:

1. An apparatus for conditioning of biologically injurious waste, such as radioactive material and the like, the apparatus including a chamber for receiving the waste material and having means for discharging the waste material to a filling station located adjacent the exterior of said chamber, said filling station having at least one storage container and including shielded means for holding said at least one container to be filled, movable lift means having means for handling the waste material, said lift means being movable toward and away from one end of said container in said filling station, said means for handling including a coupling member carried by said lift means for transmitting power to a stirring means associated with said container, driving means for driving said coupling member, a filling conduit for supplying waste material from said lift means to a storage container, a waste gas return conduit on said lift means connectable to said storage container for returning gas from the storage container to said chamber when said storage container is being filled with waste material, said apparatus further including means for securing a closure on said storage container before removal of said storage container from said filling station, said storage container having at one end thereof a closure member, said closure member having means for mounting a stirrer within the interior of said container and a coupling means for coupling with the coupling member of said lift means, said closure member having spaced apertures therein, with one of said apertures being adapted to be connected to said filling conduit of said lift means and the other aperture being adapted to be connected to said waste gas return conduit of said lift means, said lift means including spaced locating members and said closure member of said storage container having means for cooperating with said locating members of said lift means, said waste supply conduit and said waste gas return conduit on said lift means each having closure means, each said closure means including a pan connected to a shaft, means for pivoting said shaft about an axis in one direction when said shaft is moved to contact a surface of said storage container to thereby move the associated pan away from the associated conduit and for moving the pan in the opposite direction when said shaft is moved out of contact with the surface of said container to bring the associated pan into a closing relationship with respect to the associated conduit, each said shaft being carried by said lift means so as to be movable therewith toward and away from the surface of said storage container.

2. The apparatus as claimed in claim 1 wherein said coupling member carried by said lift means includes a centering pin, a yoke through which said centering pin extends and which is rotatable by said driving means and a pair of spaced driving pins extending from said yoke.

3. The apparatus as claimed in claim 1 wherein said lift means includes positioning means having at least two light signals.

4. The apparatus as claimed in claim 1 wherein said locating means comprises two spaced limit pins, said limit pins being movably mounted on said lift means for engaging a portion of the storage container when said lift means moves towards the storage container.

5. The apparatus as claimed in claim 1 wherein said storage container is constructed with double walls having a space therebetween.

6. The apparatus as claimed in claim 5 wherein divider means are provided between said double walls of said storage container.

7. The apparatus as claimed in claim 6 wherein said storage container is cylindrical and said divider means are concentrically located and are of different diameters.

8. The apparatus as claimed in claim 1 wherein said waste supply conduit and said waste air conduit are each provided with sealing means for engaging the cover of the storage container.

9. The apparatus as claimed in claim 8 wherein the openings of said waste supply conduit and said waste air conduit are each provided with closure means in the form of pans which are mounted to be swivelable between a closed position when said slidable lift moves away from said storage container and to an open position when said lift means moves towards the storage container, and pneumatic means being provided for pressing said pans onto said sealing means when in said closed position.

10. The apparatus as claimed in claim 1 wherein said waste supply conduit has at the end thereof carried on said movable lift means a valve means in the form of a conical valve element for closing said end of said waste supply conduit, said conical valve element having a shaft extending therefrom connected through sealing means to a drive motor operable to open and close said valve means.

11. The apparatus as claimed in claim 10 wherein said conical valve is provided with metallic sealing surfaces on a surface thereof engageable with said waste supply conduit.

12. The apparatus as claimed in claim 10 wherein said drive motor comprises a compressed air cylinder to open said valve means and a return spring means to close said valve means.

13. The apparatus as claimed in claim 1 wherein said shielded means for holding the storage container includes a transportation vehicle for the storage container, said transportation vehicle including a plurality of retractable wheel elements.

14. The apparatus as claimed in claim 13 wherein said wheel elements have hydraulic means to retract and extend said wheel elements.

15. The apparatus as claimed in claim 13 wherein said transportation vehicle has double walls defining a space for receiving and measuring the containing means and said double-walled portions are provided with partitions dividing the double-walled portions into several fillable compartments.

16. The apparatus as claimed in claim 1 wherein a storage container is provided with a vessel cover including stirring means and a coupling device for coupling with said coupling member carried by said lift means.

17. The apparatus as claimed in claim 16 wherein said driving means on said lift means is coupled to a dynamometer.

* * * * *